US005746620A

United States Patent [19]

Clark

[11] Patent Number: 5,746,620

[45] Date of Patent: May 5, 1998

[54] ELECTRICAL CONNECTOR INCLUDING MEANS FOR TERMINATING WIRES

[75] Inventor: Stephen L. Clark, Dillsburg, Pa.

[73] Assignee: Berg Technology, Inc., Reno, Nev.

[21] Appl. No.: 810,051

[22] Filed: Mar. 4, 1997

Related U.S. Application Data

[62] Division of Ser. No. 441,586, May 15, 1995, Pat. No. 5,639,258.

[51] Int. Cl.[6] ..... H01R 4/24

[52] U.S. Cl. ..... 439/404; 439/638

[58] Field of Search ..... 439/404, 638, 439/639, 651, 652, 654, 660, 699.1, 825

[56] References Cited

U.S. PATENT DOCUMENTS

| | | | |
|---|---|---|---|
| 4,040,702 | 8/1977 | McKee et al. | 439/399 |
| 4,050,760 | 9/1977 | Cohen | 439/399 |
| 4,113,341 | 9/1978 | Hughes | 439/620 |
| 4,283,100 | 8/1981 | Griffin et al. | 439/510 |
| 4,385,795 | 5/1983 | Endoh et al. | 439/494 |
| 4,431,249 | 2/1984 | Frantz et al. | 439/404 |
| 4,437,726 | 3/1984 | Lambert | 439/825 |
| 4,659,158 | 4/1987 | Sakamoto et al. | 439/507 |
| 4,753,616 | 6/1988 | Molitor | 439/825 |
| 4,759,725 | 7/1988 | Finch | 439/439 |
| 4,883,430 | 11/1989 | Siemon et al. | 439/510 |
| 4,907,990 | 3/1990 | Bertho et al. | 439/851 |
| 4,955,824 | 9/1990 | Pretchel et al. | 439/510 |
| 5,108,301 | 4/1992 | Totok | 439/263 |
| 5,110,304 | 5/1992 | Kjeldahl | 439/398 |
| 5,123,859 | 6/1992 | Davis et al. | 439/405 |
| 5,375,524 | 12/1994 | Larson | 102/217 |
| 5,417,593 | 5/1995 | Suzuki et al. | 439/651 |
| 5,505,631 | 4/1996 | Schauer et al. | 439/188 |

*Primary Examiner*—J. J. Swann
*Assistant Examiner*—T. C. Patel
*Attorney, Agent, or Firm*—Daniel J. Long; M. Richard Page

[57] ABSTRACT

An electrical connector assembly comprising a socket, a plug and a medial wire termination device which includes an insulative housing with a socket receiving recess at one end and a plug engaging projection at the other end. Between the socket and the plug there are transversely spaced, generally parallel metallic contacts. On each of these metallic contacts there are a pair of wire receiving terminals each of which terminals is adjacent to a wire receiving aperture in the housing.

9 Claims, 11 Drawing Sheets

ELECTRICAL CONNECTOR INCLUDING MEANS FOR TERMINATING WIRES

CROSS REFERENCE TO RELATED APPLICATION

This is a division of application Ser. No. 08/441,586 filed May 15, 1995, now U.S. Pat. No. 5,639,258.

BACKGROUND OF THE INVENTION

1. Field of the Invention

The present invention relates to electrical connectors and more particularly to electrical connectors which may be adapted for use in terminating wires.

2. Brief Description of the Prior Developments

For many applications it is frequently necessary to terminate wires for the purpose of including such wires in either a series or parallel circuit. For example, in U.S. Pat. No. 5,375,524 a blasting connection system is disclosed in which leg wires are connected to blasting caps at one end and at the other end are terminated at a wiring cable in a connecting position between a male jumper and a female jumper. For such application a need exists for a connector which can be included in a circuit and which wires to be connected to that circuit can be quickly and easily terminated.

SUMMARY OF THE INVENTION

In the electrical connector of the present invention an insulative housing has at one end a socket receiving recess and at the other end a plug engagement projection. A pair of parallel metallic contacts connect the socket receiving recess and the plug engaging projection. The metallic contacts are equipped with wire receiving vertical grooves and are positioned adjacent to wire receiving apertures in the housing. A socket which has a metallic contact which connects the one medial metallic contact to the other is attached to the socket receiving recess. Similarly, a plug which has a metallic contact which connects one of the axially metallic contacts to the other may be attached to the plug engaging projection. Wires may be inserted in the plug receiving aperture and engaged with wire termination slots to position the connector in a parallel circuit. One of the axial metallic contacts may be segmented to allow this connector to be used in a series circuit.

BRIEF DESCRIPTION OF THE DRAWINGS

The electrical connector of the present invention is further described with reference to the attached drawings in which:

FIGS. 1O*a* and 1O*b* are respectively top plan and side elevational views of the socket metallic contact before being bent into the shape shown in FIG. 8;

DETAILED DESCRIPTION OF THE PREFERRED EMBODIMENTS

Figure 1:
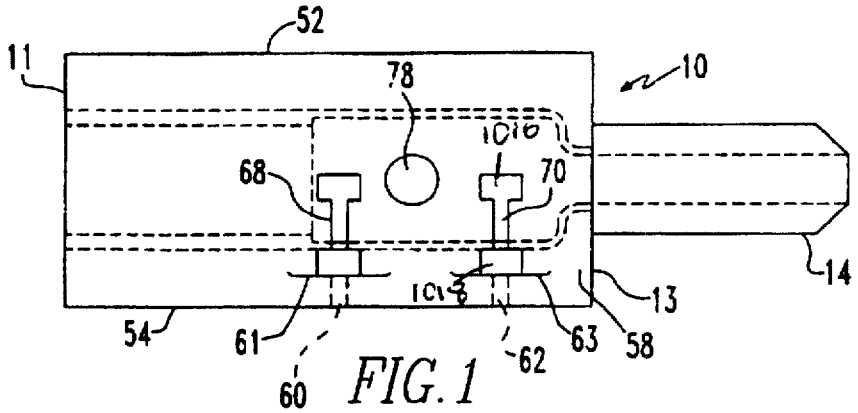
FIG. 1 is a top plan view of the connector of the present invention.
Figure 2:
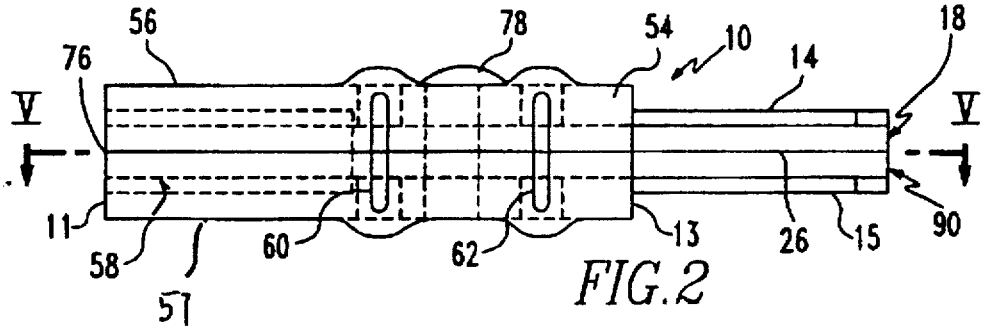
FIG. 2 is a side elevational view of the connector shown in FIG. 1.
Figure 5:
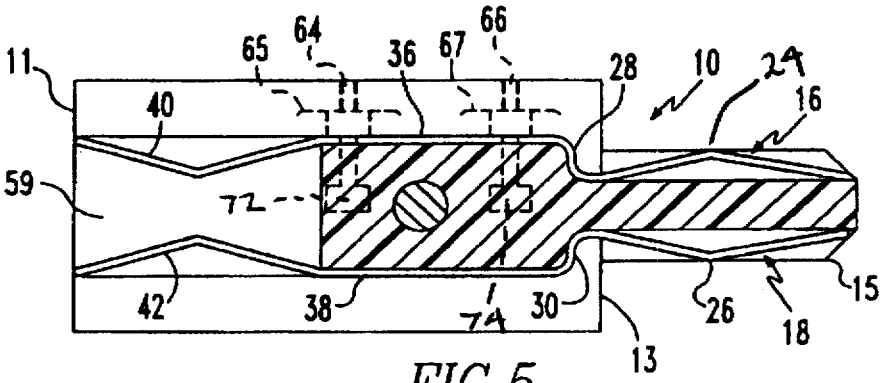
FIG. 5 is a cross sectional view through line V—V in FIG. 2.
Figure 3:
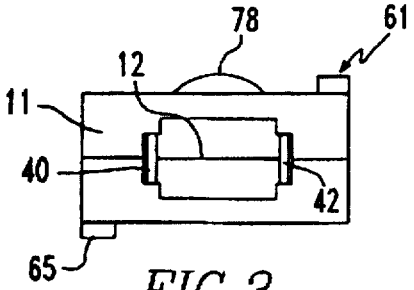
FIG. 3 is a rear end view of the connector shown in FIG. 1.
Figure 4:
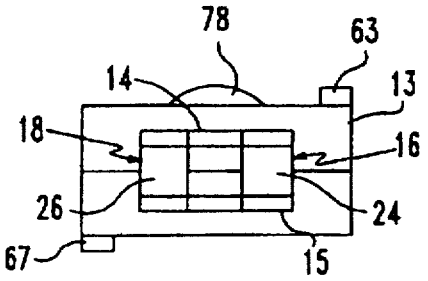
FIG. 4 is a front end view of the connector shown in FIG. 1.
Figure 6:
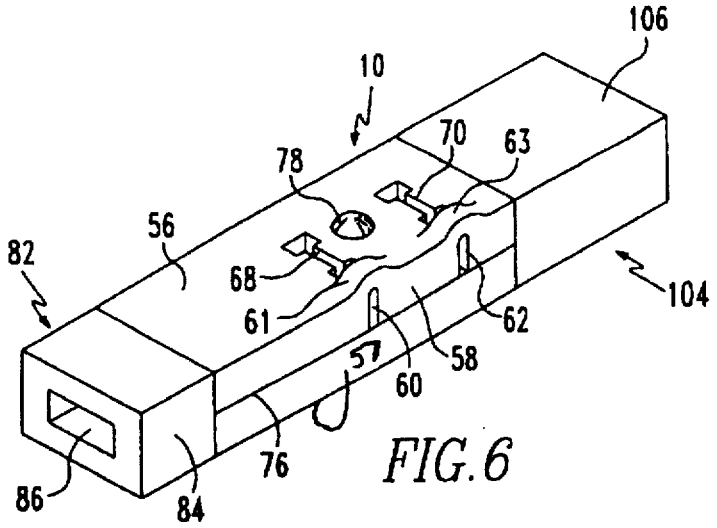
FIG. 6 is a perspective view of the connector shown in FIG. 1 which is engaged with a socket and a plug.
Figure 7:
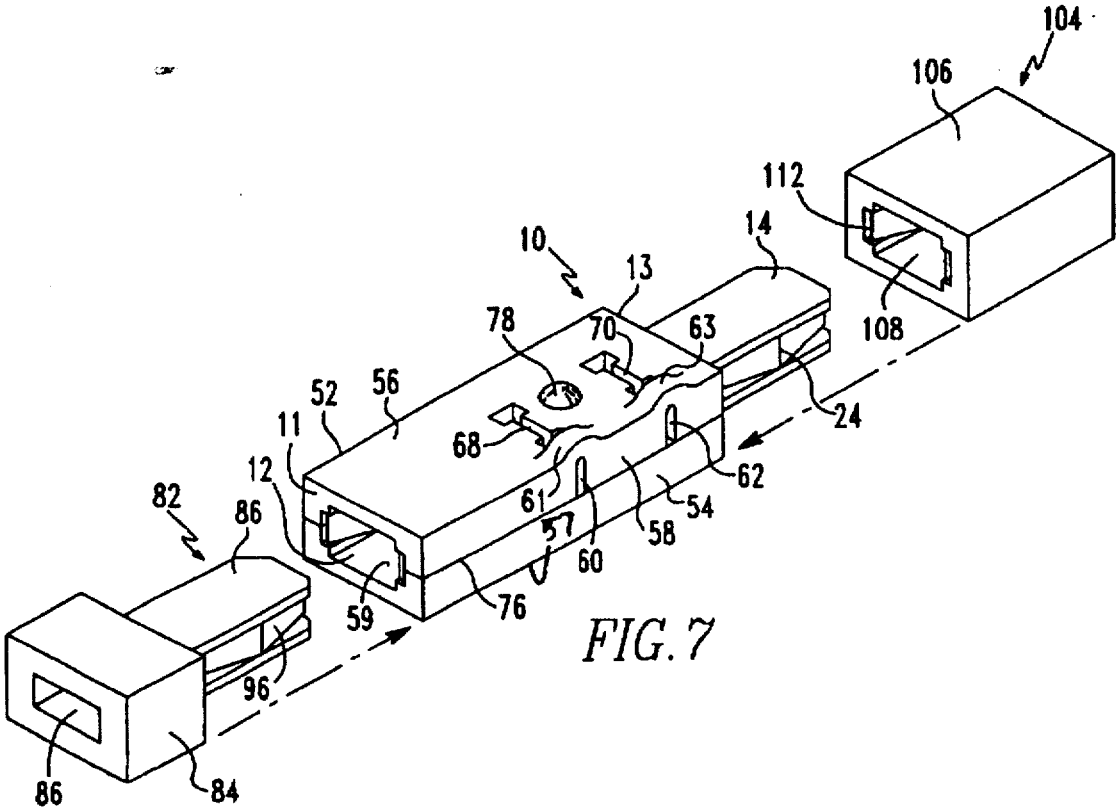
FIG. 7 is a perspective view of the connector shown in FIG. 6 with the socket and plug removed.
Figure 8:
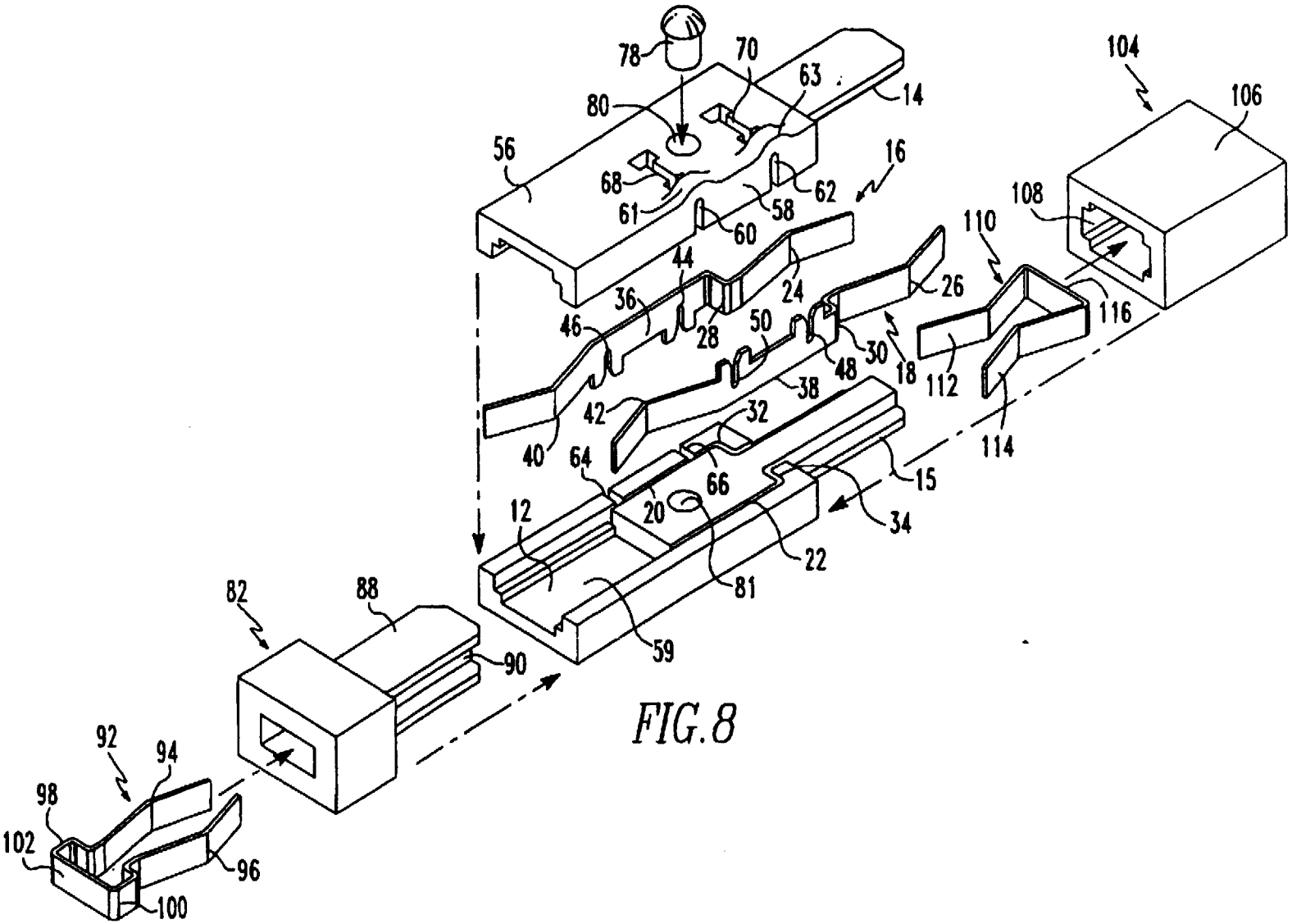
FIG. 8 is an exploded perspective view of the connector, socket and plug shown in FIG. 7.
Figure 9A:
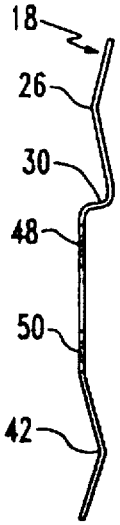
FIGS. 9*a* and 9*b* are respectively a top plan and side elevational view of an axial metallic contact as is used in the connector shown in FIG. 8.
Figure 9B:
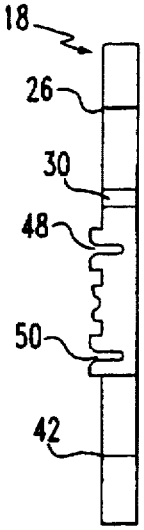
Figure 10A:
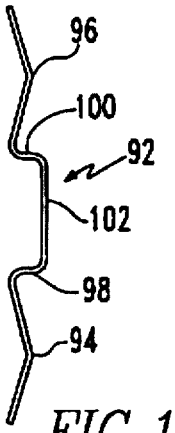
Figure 10B:
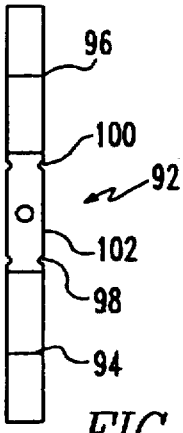
Figure 11A:
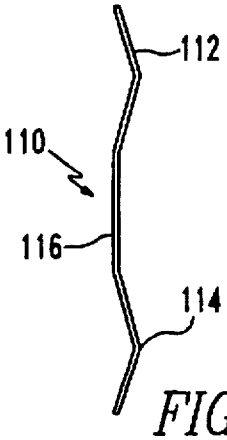
FIGS. 11*a* and 11*b* are respectively top plan and side elevational views of the plug metallic contact before being bent into the shape shown in FIG. 8.
Figure 11B:
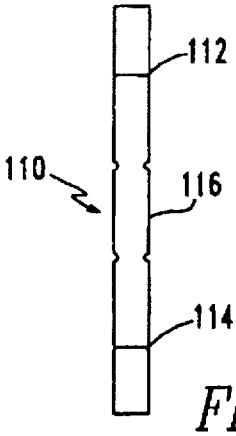

Referring to FIGS. 1 through 11*b*, the connector of the present invention includes an insulative housing shown generally at numeral 10 which has at its rear end 11 a socket receiving recess 12. At its front end 13 it has an upper plug engaging projection 14 and a lower plug engaging projection 15. The material of the insulative housing is preferably a suitable molding polypropylene. Between the socket receiving recess and the plug engaging projections there are a pair of generally parallel axial metallic contacts 16 and 18 which are retained respectively in axial grooves 20 and 22. The material of these metallic contacts and the other metallic contacts discussed herein is preferably brass or phosphor bronze alloy. These metallic contacts have respectively front angled sections 24 and 26 and shoulders 28 and 30 which are engaged by shoulder extensions 32 and 34 of the axial grooves in the housing. These metallic contacts also include respectively longitudinal sections 36 and 38 and rear angled sections 40 and 42 respectively. Positioned on the longitudinal section 36 are wire receiving slots 44 and 46. Positioned on the longitudinal slot 38 are wire receiving slots 48 and 50. The slots 44, 46, 48 and 50 may advantageously be insulation displacement contact (IDC) terminals as are disclosed, for example, in U.S. Pat. Nos. 4,050,760 and 4,385,795. The housing has lateral walls 52 and 54 and top wall 56 and bottom wall 57. Extending through the lateral walls from the exterior surface 58 to the interior surface 59 there is a wire receiving aperture 60 beneath a ridge 61 in the housing and wire receiving aperture 62 beneath a ridge 63 in the housing. Extending through the lateral wall 54 from the exterior to the interior surface there is a wire receiving aperture 64 beneath ridge 65 and wire receiving aperture 66 beneath ridge 67. On the top wall of the housing adjacent aperture 60 and 62 there are wire attachment recesses 68 and 70 by means of which a wire inserted in those apertures may be pushed downwardly to engage wire receiving slots 48 and 50 in the axial metallic contact 18. Similarly, wire attachment recesses 72 and 74 in the bottom wall 57 may be used to push wires inserted into apertures 64 and 66 into wire receiving slots 44 and 46 on the axial metallic contact 16. It will also be noted that the housing is divided into two mirror image sections at horizontal plane 76 which are attached together by fastener 78 through vertical fastener apertures 80 and 81. The engaging socket is shown generally at numeral 82 and is comprised of a housing 84 having an axial passageway 86 from which extends a forward projection 88 which has lateral side walls as at 90. A socket metallic contact which is shown generally at 92 has outwardly angled legs 94 and 96 which connect respectively to shoulders 98 and 100 between base section 102. This socket metallic contact is inserted in the passageway and its legs extend forward to laterally abut the side walls of the forward projection. The plug is shown generally at numeral 104 and includes a housing 106 having an axial recess 108 in which a plug metallic contact shown generally at 110 is inserted. This plug metallic contact has inwardly angled legs 112 and 114 which are positioned between a base section 116.

Figure 12:
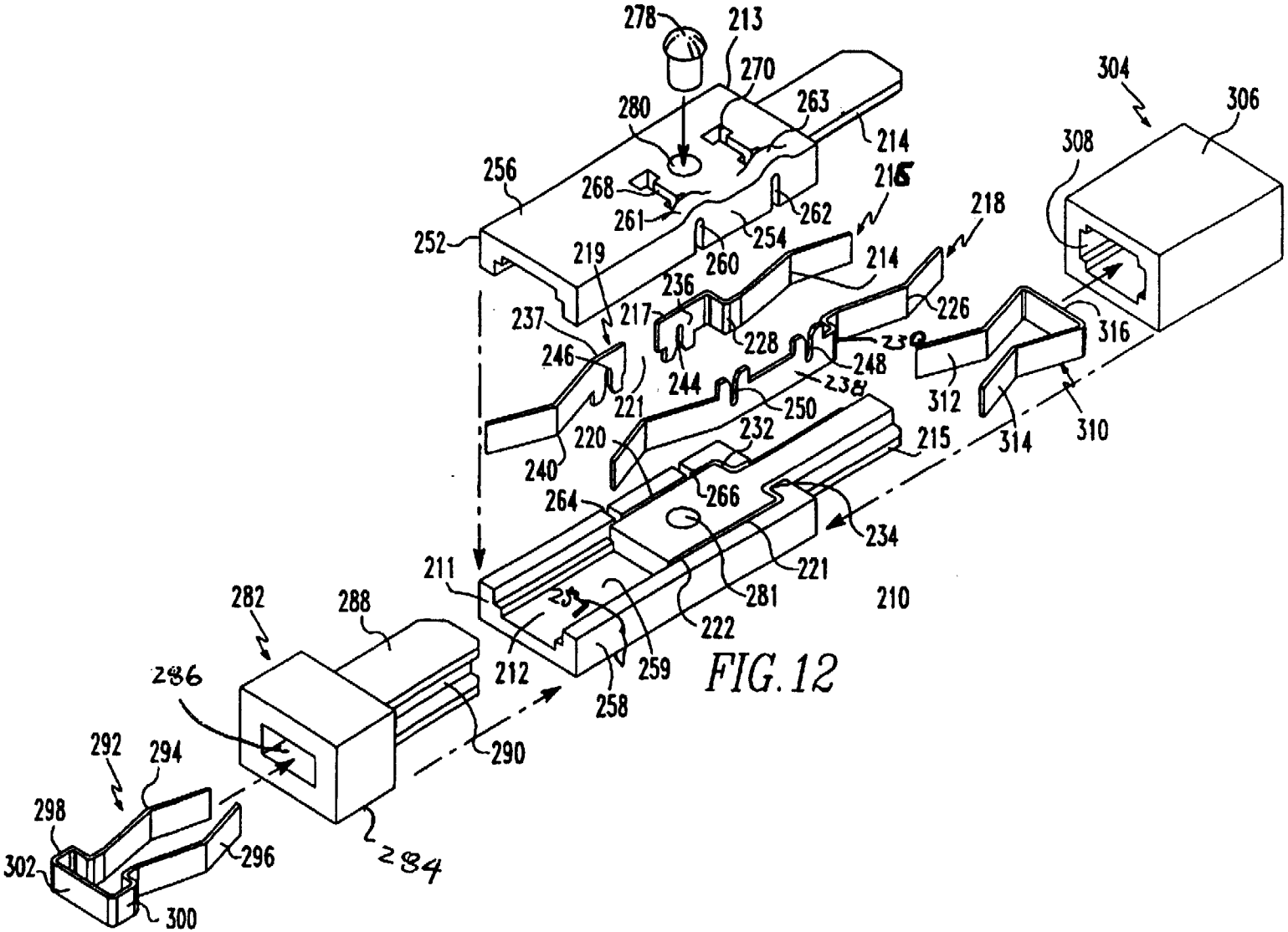
FIG. 12 is an exploded perspective view similar to FIG. 8 of another embodiment of the electrical connector of the present invention.

Another embodiment of the connector assembly of the present invention is shown in FIG. 12. This embodiment includes a medial wire termination connector device which includes an insulative housing shown generally at numeral 210 which has at its rear end 211 a socket receiving recess 212. At its front end 213 it has an upper plug engaging projection 214 and a lower plug engaging projection 215. Between the socket receiving recess and the plug engaging projections there are a pair of generally parallel axial metallic contacts shown generally at numerals 216 and 218 which are retained respectively in axial grooves 220 and 222. It will be noted that metallic contact 216 is segmented into front and rear sections shown generally at numerals 217 and 219 respectively which are separated by air gap 221. These metallic contacts have respectively front angled sections 224 and 226 and shoulders 228 and 230 which are engaged by shoulder extensions 232 and 234 of the axial grooves in the housing. The metallic contact segments 217 and 219 also include respectively longitudinal sections 236 and 238. Metallic contact 218 includes longitudinal segment 238. The contacts also include rear angled sections 240 and 242 respectively. Positioned on the longitudinal sections 236 and 237 are, respectively, wire receiving slots 244 and 246. Positioned on the longitudinal section 238 are wire receiving slots 248 and 250. The slots 244, 246, 248 and 250 may advantageously be insulation displacement contact (IDC) terminals. The housing has lateral walls 252 and 254 and top wall 256 and bottom wall 257. Extending through the lateral walls from the exterior surface 258 to the interior surface 259 there is a wire receiving aperture 260 beneath a ridge 261 in the housing and wire receiving aperture 262 beneath a ridge 263 in the housing. Extending through the lateral wall 254 from the exterior to the interior surface there is a wire receiving aperture 264 ridge (not shown) in the housing and wire receiving aperture 266 above another ridge (not shown) in the housing. On the top wall of the housing adjacent aperture 260 and 262 there are wire attachment recesses 268 and 270 by means of which a wire inserted in those apertures may be pushed downwardly to engage wire receiving slots 248 and 250 in the axial metallic contact 218. Similarly, other wire attachment recesses (not shown) in the bottom wall 257 may be used to push wires inserted into apertures 264 and 266 upwardly into wire receiving slots 244 and 246 on the axial metallic contact 216. It will also be noted that the housing is divided into two mirror image sections at a horizontal plane which are attached together by fastener 278 through vertical fastener apertures 280 and 281. The engaging socket is shown generally at numeral 282 and is comprised of a housing 284 having an axial passageway 286 and from which extends a forward projection 288 which has lateral side walls as at 290. A socket metallic contact which is shown generally at 292 has outwardly angled legs 294 and 296 which connect respectively to shoulders 298 and 300 between base section 302. This socket metallic contact is inserted in the passageway and its legs extend forward to laterally abut the side walls of the forward projection. The plug is shown generally at numeral 304 and includes a housing 306 having an axial recess 308 in which a plug metallic contact shown generally at 310 is inserted. This plug metallic contact has inwardly angled legs 312 and 314 which are positioned between a base section 316.

Figure 13:
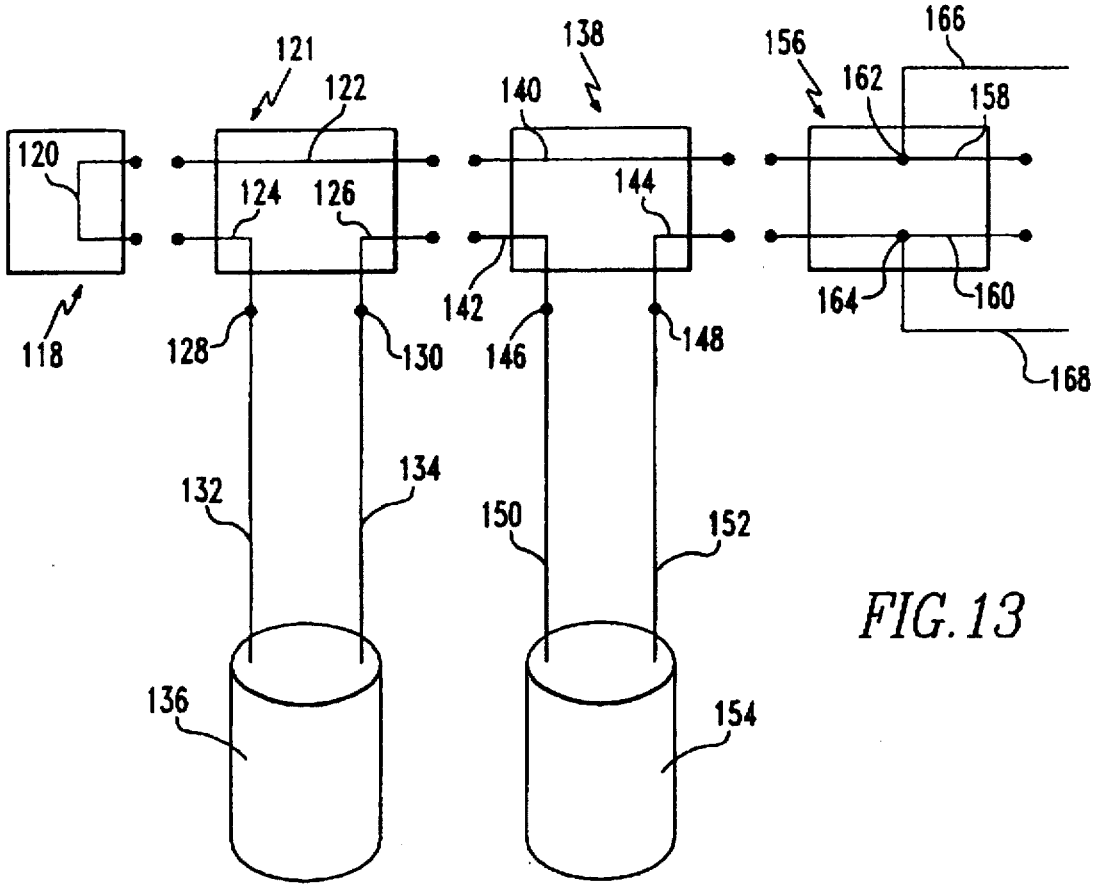
FIG. 13 is a schematic illustration of the use of the connector of the present invention in a blasting circuit.

Referring particularly to FIG. 13, one use of the connector described above is shown in greater detail wherein the socket described is at numeral 118 with its metallic contact 120 and is connected to a connector shown generally at 121 with a longitudinal axial metallic contact being at 122 and split metallic contact sections at 124 and 126. The split metallic contacts 124 and 126 which have, respectively, wire terminals 128 and 130 which receive wires 132 and 134 which are connected at their opposite ends to blasting cap 136. Another connector shown generally at 138 is arranged for use in series and has a longitudinal axial metallic contact 140 and split metallic contact sections 142 and 144. These split metallic contact sections have wire terminals respectively at 146 and 148 and which are connected, respectively, to wires 150 and 152 which are connected at their opposite ends to blasting cap 154. A connector arranged for use in a parallel circuit is shown generally at numeral 156. This connector 156 has longitudinal axial metallic contacts 158 and 160 which have wire terminals respectively at 162 and 164 which are connected to blasting cables 166 and 168 which terminate at a blasting machine at their opposite ends (not shown).

Figure 14A:
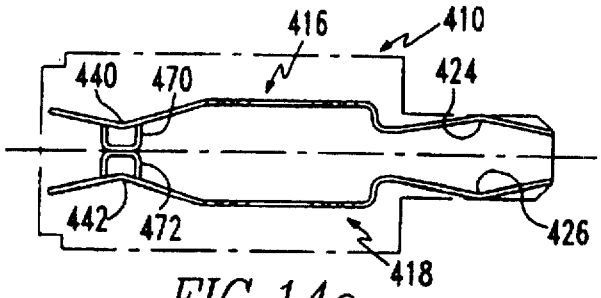
FIGS. 14*a* and 14*b* are top plan schematic illustrations of the axial metallic contacts used in the connector in the present invention in an alternate arrangement.
Figure 14B:
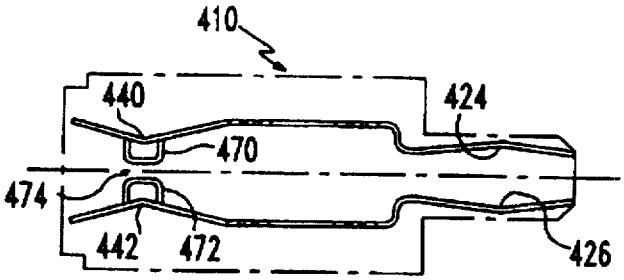

Another arrangement of the axial metallic contacts is shown in FIGS. 14*a* and 14*b*. In this arrangement it is possible to provide electrical continuity between the two contacts without use of the socket or plug. The insulative housing as was generally described above, is shown at 410 and the contacts shown generally at 416 and 418 are identical to those described above except that extensions 470 and 472 extend from the rearward section and make contact with each other. When force is applied to the forward angled section the contacts flex so that these projections are separated and electrical continuity is interrupted by air gap 474.

Figure 15A:
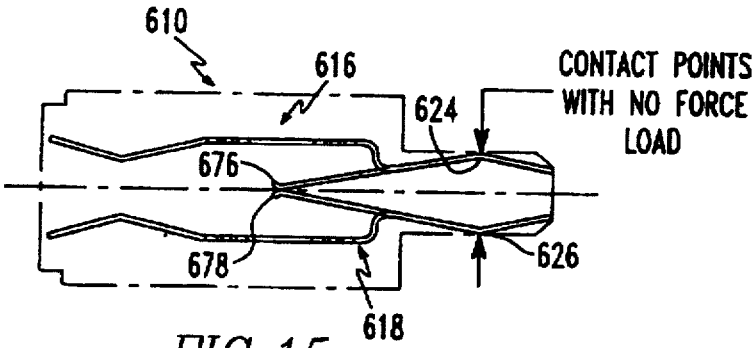
FIGS. 15*a* and 15*b* are top plan schematic illustrations of the axial metallic contacts used in the connector in the present invention in another alternate arrangement.
Figure 15B:
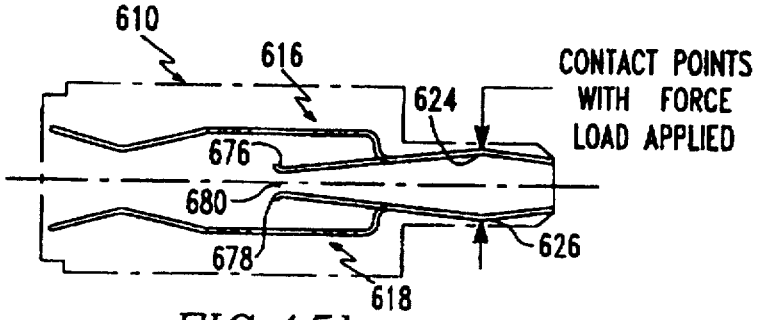

In another alternate arrangement, mounted in insulative housing 610 are axial metallic contacts 616 and 618 which are also essentially identical to the contacts described except that additional beams 676 and 678 extend diagonally and rearwardly from the forward angled section. Ordinarily these beams would abut as is shown in FIG. 15*a* but when pressure is applied to the forward angle section they separate to interrupt this continuity.

Figure 16A:
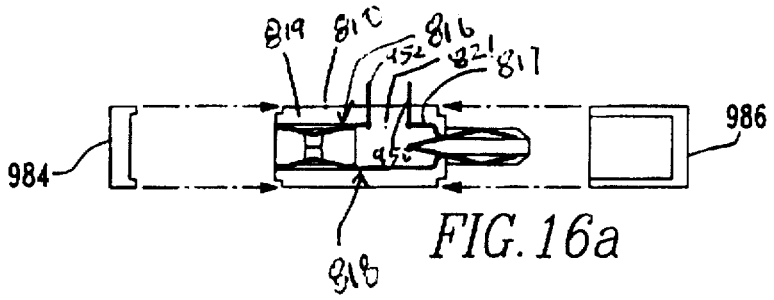
FIGS. 16*a* and 16*b* are top plan schematic illustrations of the axial metallic contacts of the metallic contacts used in the connector of the present insertion in still another alternate arrangement along socket and plug and closed contacts.
Figure 16B:
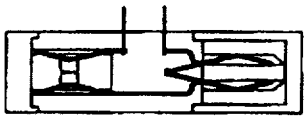

From FIGS. 16*a* and 16*b* it will be seen that such alternate arrangements may include a rearward contact and front beam contacts in the same arrangement and may be used in an arrangement with one split metallic contact as would be used to achieve a series connection as was explained above. In this embodiment in the insulative housing 810 there are metallic contacts shown generally at numerals 816 and 818. It will be observed that contact 816 is segmented into split metallic contact sections 817 and 819 which are separated by air gap 821. These contact sections are respectively connected to wires 950 and 952 for allowing the connector to be used in a series in a circuit. This connector may also be equipped with a removable plug end closed cap 984 and socket end closed cap 986 which are shown disengaged in FIG. 16*a* and engaged in FIG. 16*b*.

Figure 17A:
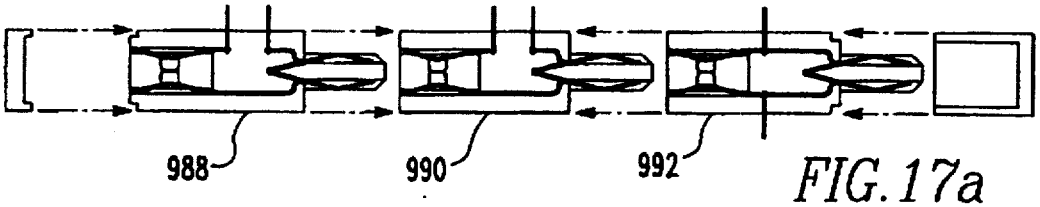
FIGS. 17*a*, 17*b* and 17*c* are top plan schematic illustrations showing the use of connectors having the axial metallic contacts illustrated in FIGS. 16*a* and 16*b;*
Figure 17B:
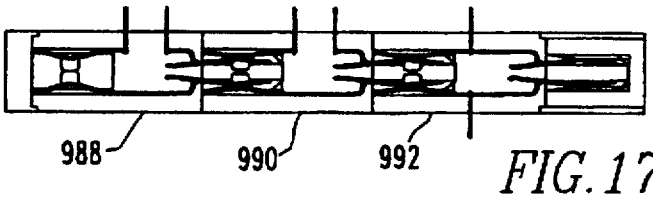
Figure 17C:
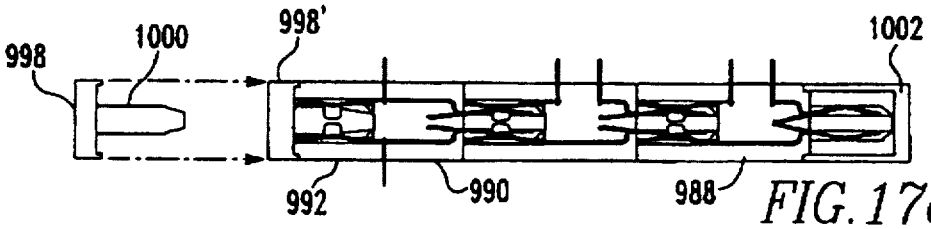
Figure 18:
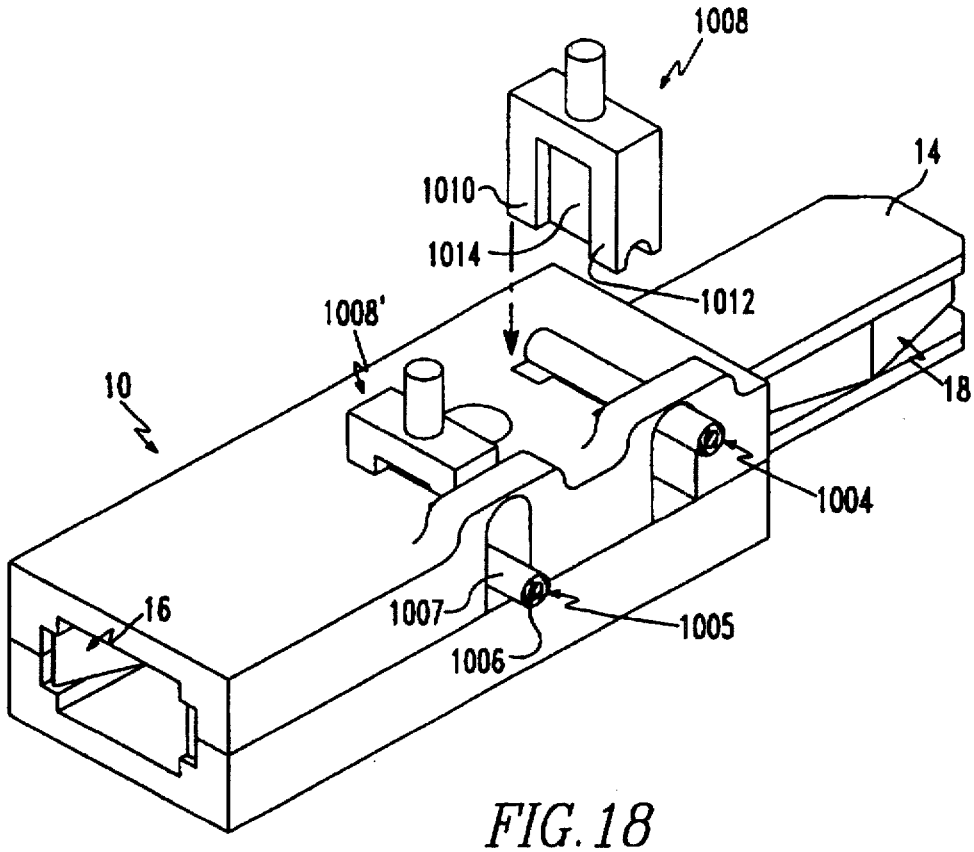
FIG. 18 is a perspective view of the connector shown in FIG. 1 in which the termination of wires is illustrated.
Figure 19:
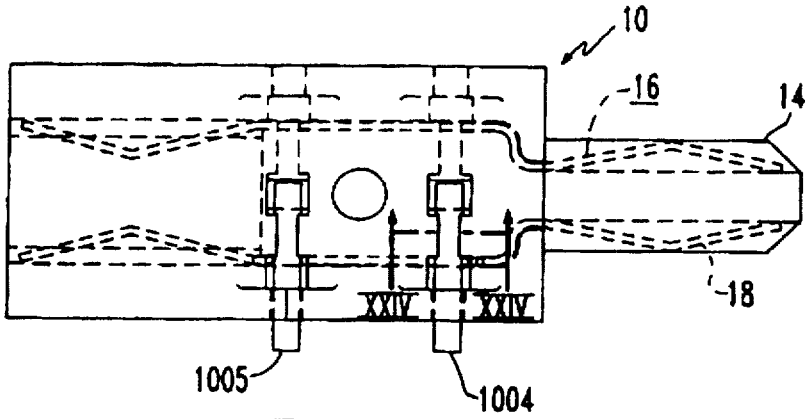
FIG. 19 is a top plan view of the connector and wire assembly shown in FIG. 18.
Figure 20:
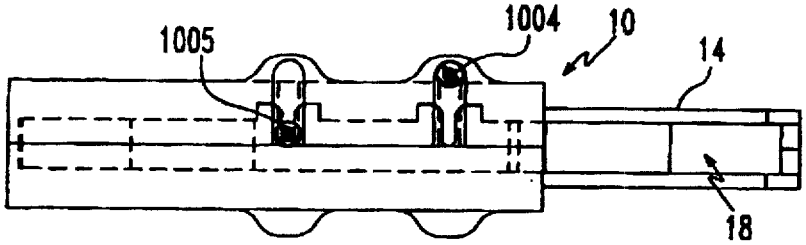
FIG. 20 is a side elevational view of the connector and wire assembly shown in FIG. 18.
Figure 21:
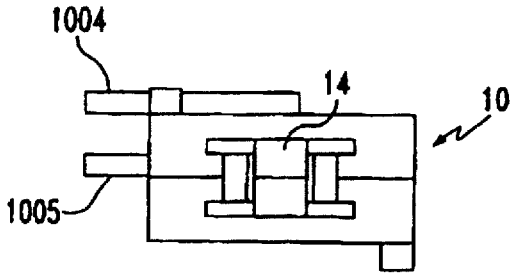
FIG. 21 is a front end view of the connector and wire assembly shown in FIG. 18.
Figure 22A:
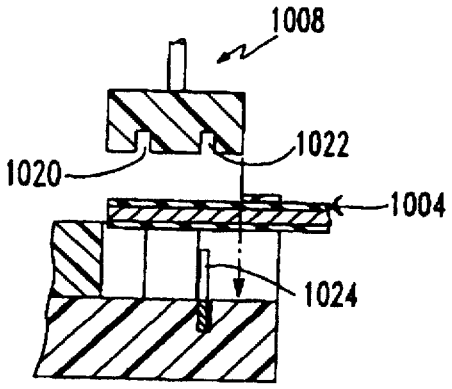
FIGS. 22*a* and 22*b* are schematic side views illustrating the insertion of a wire in the connector of the present invention.
Figure 23A:
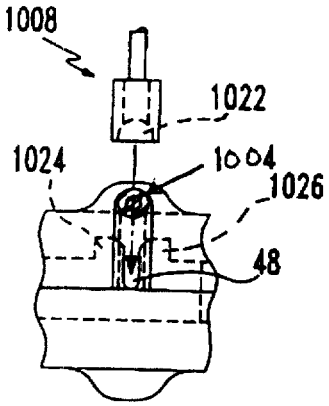
FIGS. 23*a* and 23*b* are schematic end views illustrating the insertion of a wire in the connector of the present invention.
Figure 22B:
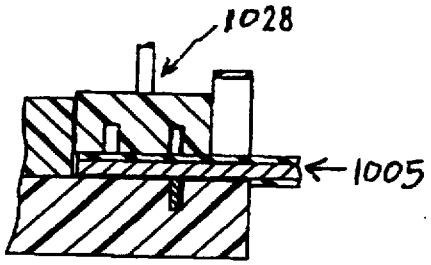
Figure 23B:
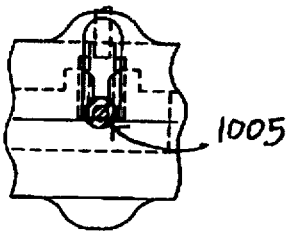

Referring to FIGS. 17*a*, 17*b* and 17*c* the use of a connector as is shown in FIGS. 16*a* and 16*b* is illustrated. In FIG. 17*a* two connectors which have one segmented metal contact to be arranged for series connection are shown generally at numerals 988 and 990. Another connector with no segmented metallic contacts and arranged for parallel connection is shown generally at numeral 992 and a plug end closed contact cap are also included in this assembly. Referring particularly to FIG. 17*b* it will be seen that when connector 988 is engaged with connector 990 and connector 990 is engaged with connector 992 and connector 992 is connected with the plug end contacts the front contacts of connectors 990 and 992 and the rear contacts of connector 990 are held in an open position while the rear contacts of connector 988 are closed. A different arrangement is shown in FIG. 17*c* in which a socket end closed contact cap 998 having a projection 1000 holds open the rear contacts of connector 992 when it is engaged at 988 a different socket end connector 1002 does not, on the other hand, exert sufficient force on the metallic contacts to open the front beams, but the front beams of connectors 990 and 992 and the rear contacts of connectors 988 and 990 are opened as a result of the particular arrangement shown.

Figure 24:
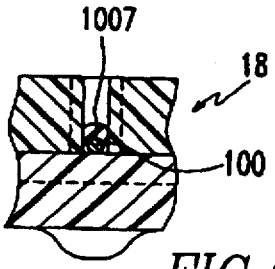
FIG. 24 is a schematic cross sectional view through line XXIV—XXIV in FIG. 19 further illustrating the insertion of a wire in the connector of the present invention.

Referring to FIGS. 18–24, the termination of wires in the connector of the present invention is shown in greater detail. In FIGS. 18–21 wire 1004 is shown in an initial position prior to insertion, and wire 1005 is shown in an inserted position. The wire includes a conductor 1006 and an insulator 1007. A tool as is generally shown at 1008 and 1008' is used to move a wire from this initial position to its inserted position. The tool has wide opposed end sections 1010 and 1012 and a narrow central section 1014 so that it is cross sectionally "H." Referring to FIG. 1, it will be noted that the wire attachment apertures as at 70 have wide end sections as at 1016 and 1018 and that the wide sections of the insertion tool fit into these wide sections of the wire insertion apertures. Referring particularly to FIGS. 23*a*–24*b*, a schematic representation of the insertion of a wire is shown in still further detail. From the initial position shown in FIGS. 22*a* and 23*a* the insertion tool is pressed downwardly on the wire. The insertion tool has recesses 1020 and 1022 to avoid ridges as at 1024 and 1026 adjacent the wire receiving slots as at 48. As the wire is pressed downwardly, the metallic contact adjacent to the wire receiving slot removes insulation in a narrow well know in the art so that when the wire is fully inserted at the positions shown in FIGS. 22*b* and 23*b* the conductor section of the wire makes metallic contact as is shown in FIG. 24. It will be appreciated that an electrical connector and an electrical connector assembly including an integral socket and plug has been described which allows wires to be quickly, efficiently and economically to be terminated for inclusion within either a series or parallel circuit.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector interposed between a socket and a plug comprising:

a socket engagement means, a plug engagement means, opposed lateral walls, first and second opposed ends, an exterior and interior surfaces, and a medial electrical conductive means;

the socket engagement means being at the first end and the plug engagement means being at the second end, the socket engagement means having a receiving recess for receiving said socket;

the medial electrical conductive means connects the socket engagement means and the plug engagement means and comprising two metallic contacts contained at least partially within said insulative housing, one of said metallic contacts connecting the socket engagement means to the plug engagement means and the other of said metallic contacts being segmented into at least two axially spaced segments and each of said contacts having a wire terminal means comprising at least one transverse slot;

wire access means comprising at least a pair of apertures in the insulative housing each of which is aligned with one of said transverse slots, for allowing entry of wires into said insulative housing for engagement with said wire terminal means;

said socket having a projection portion including opposed lateral walls, the projection portion being inserted in the socket receiving recess, the socket further comprising socket metallic contact means, the socket metallic contact means having two legs and a base side interposed therebetween, and positioned such that each of the legs abuts one of said opposed lateral walls and one of the medial metallic contact means.

2. The electrical connector assembly of claim 1 wherein the metallic contacts are transversely spaced in generally parallel arrangement.

3. The electrical connector of claim 1 wherein each of the metallic contacts are fixed inside the housing by axial retaining means.

4. The electrical connector of claim 1 wherein the plug engagement means has a projection portion, the projection portion being inserted in a projection receiving recess including opposed lateral walls in the plug, the plug further comprising plug metallic contact means, the plug metallic contact means having two legs and a base side interposed therebetween, and positioned such that each of the legs abuts one of said opposed lateral walls of said projection receiving recess and one of the medial metallic contact means.

5. The electrical connector of claim 4 wherein the legs of the plug metallic contact means resiliently abut the medial metallic contacts.

6. The electrical connector of claim 1 wherein the plug engagement means comprises an axial projection.

7. The electrical connector of claim 1 wherein the legs of the socket metallic contact means resiliently abut the medial metallic contacts.

8. The electrical connector of claim 1 wherein the wire terminal means comprises at least one insulation displacement contact (IDC) terminal.

9. The electrical connector of claim 1 wherein each of said metallic contacts has a front outwardly angled section, a medial longitudinal section and a rear inwardly angled section.

* * * * *